US005924679A

United States Patent [19]

Wilson

[11] Patent Number: 5,924,679

[45] Date of Patent: Jul. 20, 1999

[54] SPIKE REMOVING SYSTEM

[76] Inventor: Tim R. Wilson, 1805 2nd Ave. North, Moorhead, Minn. 56560

[21] Appl. No.: 08/963,319

[22] Filed: Nov. 3, 1997

[51] Int. Cl.[6] ..... B25C 11/00

[52] U.S. Cl. ..... 254/18; 254/24; 254/22

[58] Field of Search ..... 254/18, 24, 22, 254/23, 93 R, 30

[56] References Cited

U.S. PATENT DOCUMENTS

| | | | |
|---|---|---|---|
| 842,185 | 1/1907 | Dudley | 254/18 |
| 1,516,155 | 11/1924 | Santarelli | 254/18 |
| 1,771,712 | 7/1930 | Jimerson | 254/18 |
| 2,691,505 | 10/1954 | Hursh . | |
| 2,732,173 | 1/1956 | Hursh . | |
| 2,797,889 | 7/1957 | Talboys . | |
| 2,826,446 | 3/1958 | Hursh . | |
| 2,846,187 | 8/1958 | Sublett et al. . | |
| 2,945,674 | 7/1960 | Hursh . | |
| 3,105,674 | 10/1963 | Stewart . | |
| 3,137,479 | 6/1964 | Sheperd et al. . | |
| 5,253,844 | 10/1993 | Cotic et al. | 257/18 |
| 5,566,924 | 10/1996 | Shirk . | |

*Primary Examiner*—David A. Scherbel
*Assistant Examiner*—Daniel G. Shanley
*Attorney, Agent, or Firm*—Michael S. Neustel

[57] ABSTRACT

A spike removing system for removing deeply embedded spikes from railroad tracks. The inventive device includes a housing having an open end, an upper hydraulic cylinder attached within an upper portion of the housing, a lower hydraulic cylinder having a plurality of opposing first jaws and second jaws pivotally attached thereto, and a plunger head attached to the lower hydraulic cylinder for closing and separating the opposing first jaws and second jaws with respect to one another. The first and second jaws are preferably S-shaped and include a channel for allowing the opposing jaw to slidably move with respect to the other jaw. The jaws project downwardly when closed upon a spike, thereby digging into the tie to ensure proper engagement with the head of a deeply embedded spike.

4 Claims, 2 Drawing Sheets

SPIKE REMOVING SYSTEM

BACKGROUND OF THE INVENTION

1. Field of the Invention

The present invention relates generally to rail pin removing devices and more specifically it relates to a spike removing system for removing spikes from railroad tracks which are deeply embedded within a tie.

2. Description of the Prior Art

There are numerous rail pin removing devices. For example, U.S. Pat. No. 2,797,889 to Talboys; U.S. Pat. No. 2,945,674 to Hursh; U.S. Pat. No. 2,691,505 to Hursh; U.S. Pat. No. 5,566,924 to Shirk; U.S. Pat. No. 2,732,173 to Hursh; U.S. Pat. No. 2,826,446 to Hursh; U.S. Pat. No. 2,846,187 to Sublett et. al.; U.S. Pat. No. 3,105,674 to Stewart; U.S. Pat. No. 3,137,479 to Sheperd et. al. all are illustrative of such prior art.

Talboys (U.S. Pat. No. 2,797,889) discloses a spike pulling implement comprising an elongated frame, a spike-gripping claw mounted for reciprocating movement to the frame and a means for reciprocating the claw. The frame includes an opening which is generally coextensive with the range of movement of the claw.

Hursh (U.S. Pat. No. 2,945,674) discloses a spike pulling grapple generally comprising a housing, means for lowering the housings to grip the spike and raising the spike, and a pair of spike engaging hooks mounted slidably in the housing.

While these devices may be suitable for the particular purpose to which they address, they are not as suitable for removing deeply embedded spikes. The claws of the prior art do not project downwardly when closing and some actually move upwardly while closing upon the spike. This causes the prior art inventions to miss engaging a deeply embedded spike. The claws of the present invention, however, do project downwardly when closing, thereby insuring engagement of deeply embedded spikes.

In these respects, the spike removing system according to the present invention substantially departs from the conventional concepts and designs of the prior art, and in so doing provides an apparatus primarily developed for the purpose of removing deeply embedded spikes from railroad tracks.

SUMMARY OF THE INVENTION

A primary object of the present invention is to provide a spike removing system that will overcome the shortcomings of the prior art devices.

Another object is to provide a spike removing system that removes spikes from railroad tracks.

An additional object is to provide a spike removing system that is capable of removing deeply embedded railroad spikes.

A further object is to provide a spike removing system where the claws project downwardly during engagement with the spike.

Another object is to provide a spike removing system that reduces the chance of slippage of the claw from a head of the spike to be removed.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 2:
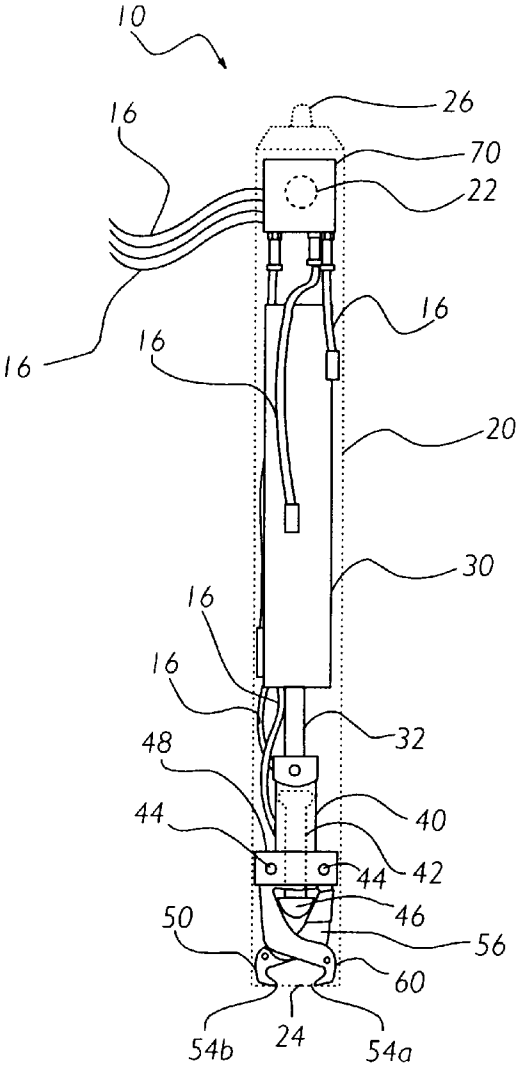
FIG. 2 is a side view with the jaws open.

Turning now descriptively to the drawings, in which similar reference characters denote similar elements throughout the several view, FIGS. 1 through 5 illustrate a spike removing system 10, which comprises a housing 20 having an open end, an upper hydraulic cylinder 30 attached within an upper portion of the housing 20, a lower hydraulic cylinder 40 having a plurality of opposing first jaws 50 and second jaws 60 pivotally attached thereto, and a plunger head 46 attached to the lower hydraulic cylinder 40 for closing and separating the opposing first jaws 50 and second jaws 60 with respect to one another. The first and second jaws 60 are preferably S-shaped and include a channel 56 for allowing the opposing jaw to slidably move with respect to the other jaw. The jaws project downwardly when closed upon a spike 12, thereby digging into the tie 14 to ensure proper engagement with the head of a deeply embedded spike 12.

Figure 1:
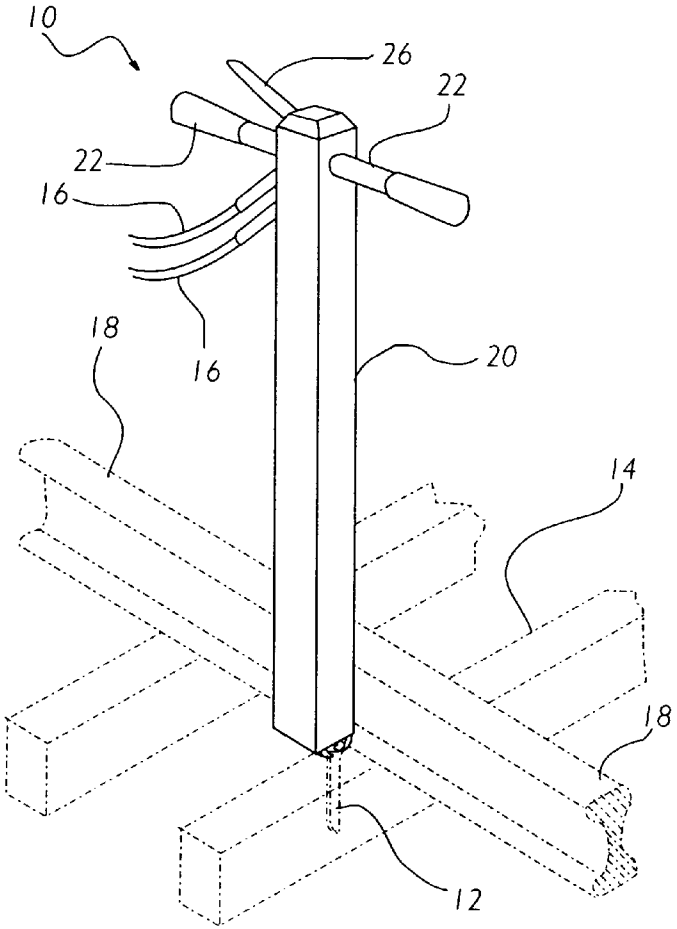
FIG. 1 is an upper perspective view of the present invention engaging a spike.

As best shown in FIG. 1, the housing 20 is an elongated structure having an upper and a lower end. The housing 20 further has an unnumbered lumen which is connected to the lower end. The lower end includes an opening 24 as shown in FIG. 2 of the drawings. The housing 20 further includes a pair of handles 22 for allowing a user to easily manipulate the present invention. A lever 26 is pivotally attached to a hydraulic control unit 70 as shown in FIGS. 1 and 2 of the drawings. The lever 26 is manipulated by the user by grasping the lever 26 with their hand.

As best shown in FIG. 2 of the drawings, the upper hydraulic cylinder 30 has a first inner shaft 32 and is hydraulically connected to the hydraulic control unit 70 by a pair of hoses 16. The hydraulic control unit 70 controls the extension and contraction of the first inner shaft 32 from the upper hydraulic cylinder 30. The upper hydraulic cylinder 30 is attached within an upper portion of a lumen of the housing 20 as shown in FIG. 2. The first inner shaft 32 projects downwardly towards the lower end of the housing 20 within the unnumbered lumen.

Figure 5:
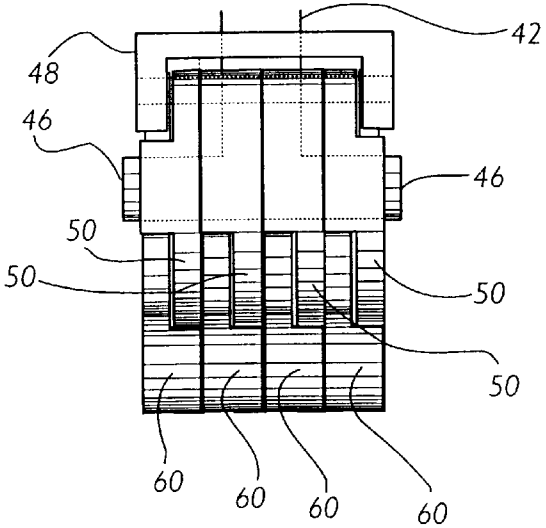
FIG. 5 is a front view of the jaws.
Figure 3:
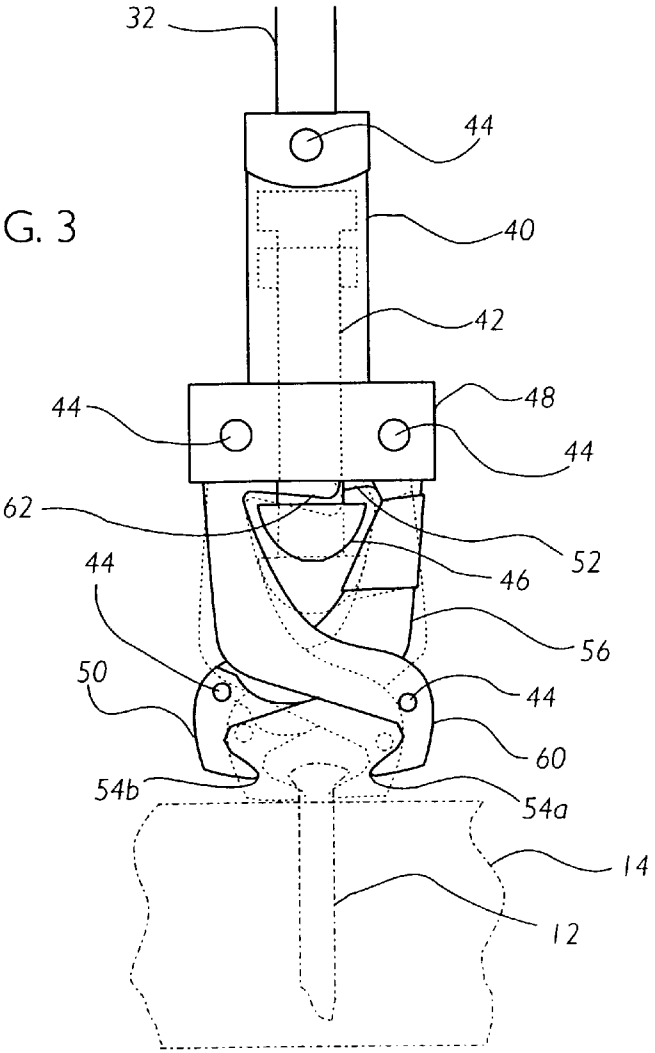
FIG. 3 is a magnified side view with the jaws shown in the open and closed positions.

The lower hydraulic cylinder 40 is attached to an end of the first inner shaft 32 opposite of the upper portion of the housing 20 by a fastener 44 and is hydraulically connected to the hydraulic control unit 70. The lower hydraulic cylinder 40 includes a second inner shaft 42 projecting downwardly towards the lower end as best shown in FIGS. 2 and 3 of the drawings. The plunger head 46 is attached to an end of the second inner shaft 42 opposite of the first inner shaft 32. As best shown in FIG. 3, a head member 48 is attached about the lower hydraulic cylinder 40. The head member 48 is preferably U-shaped as best shown in FIG. 5 of the drawings.

Figure 4:
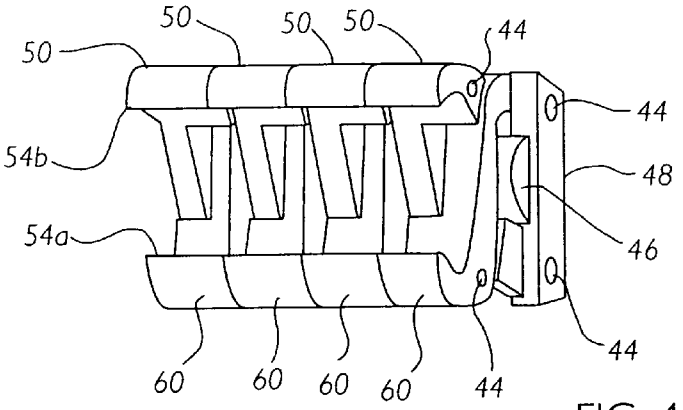
FIG. 4 is a lower perspective view of the jaws.

The first jaws 50 are attached to one another by a fastener 44 as shown in FIGS. 3 and 4. The second jaws 60 are attached to one another by a fastener 44 also as shown in FIGS. 3 and 4. Therefore, the plurality of first jaws 50 move in synchronization and the plurality of second jaws 60 move in synchronization. The jaws 50, 60 preferably are S-shaped and have a lower end 54 as shown in FIGS. 2 through 5. The lower ends 54 engage the head of the spike 12 as shown in FIGS. 1 and 3 of the drawings. The jaws 50, 60 include a channel 56 centrally positioned for slidably receiving a portion of the opposing jaw. The plurality of first jaws 50 are pivotally attached to the head member 48 opposite of the lower end 54. The plurality of second jaws 60 are pivotally attached to the head member 48 opposite of the lower end 54 and opposite of the plurality of first jaws 50. The second jaws 60 are in a reverse position with respect to the first jaws 50 as best shown in FIGS. 2 and 3 of the drawings. The opposing lower ends of the jaws 50, 60 are brought together by the plunger head 46 slidably projecting between an upper portion of the jaws 50, 60 as shown in FIG. 3 of the drawings. The first jaws 50 include at least one first tongue member 52 attached substantially traverse to a longitudinal axis of the housing 20. The second jaws 60 include at least one second tongue member 62 attached substantially traverse to the longitudinal axis of the housing 20 as shown in FIG. 3 of the drawings. The tongue members 52, 62 are engaged by a lip portion of the plunger head 46 when the plunger head 46 is retracted from the jaws 50, 60 thereby opening 24 the jaws 50, 60 with respect to one another.

In use, the user manipulates the present invention so that the lower ends 54 of the jaws 50, 60 are surrounding a spike 12 embedded within a tie 14 securing a rail 18. The user thereafter manipulates the lever 26 which is connected to the hydraulic control unit 70. The hydraulic control unit 70 hydraulically manipulates the lower hydraulic cylinder 40 so as to extend the second inner shaft 42 therefrom within. The plunger head 46 thereafter engages the upper portion between the jaws 50, 60 thereby closing the opposing lower ends 54 of the jaws 50, 60 about the spike 12 and projecting slightly into the tie 14 as shown in FIG. 3 of the drawings. After the second inner shaft 42 is fully extended, the hydraulic control unit 70 hydraulically manipulates the upper hydraulic cylinder 30 so as to retract the first inner shaft 32 thereby elevating the jaws 50, 60 and the engaged spike 12 from the tie 14. The first inner shaft 32 is retracted until the spike 12 is completely removed from the tie 14. The hydraulic control unit 70 thereafter manipulates the lower hydraulic cylinder 40 to retract the second inner shaft 42. The lip portion of the plunger head 46 engages the first tongue member 52 and the second tongue member 62 thereby opening 24 the jaws 50, 60. The spike 12 is then released and is released through the opening 24 in the lower end of the housing 20. The upper hydraulic cylinder 30 is thereafter manipulated by the hydraulic control unit 70 to extend the first inner shaft 32 so that the lower ends of the jaws 50, 60 are substantially flush with the opening 24 in the lower end of the housing 20 as shown in FIG. 2 of the drawings.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A spike removing system comprising:

a housing having an upper end and a lower end, said lower end including an opening;

a lifting means secured within said housing;

an engaging means attached to said lifting means for engaging a deeply embedded spike;

wherein said engaging means projects downwardly during engagement of said spike;

wherein said engaging means projects into a tie containing said spike a finite distance to ensure proper engagement with a head portion of said spike;

wherein said engaging means comprises at least one pair of jaws having a corresponding lower end opposing one another, wherein said at least one pair of jaws are pivotally attached to a means for closing and opening said pair of jaws;

wherein said pair of jaws are substantially S-shaped and said pair of jaws are reversed with respect to one another so that said lower ends are opposing one another;

wherein said means for closing and opening solid pair of jaws comprises:

a lower hydraulic cylinder having a second inner shaft, wherein said lower hydraulic cylinder is attached to said lifting means; and a plunger head attached to a distal end of said second inner shaft, wherein said plunger head projects between an upper portion of said pair of jaws for closing said pair of jaws; and wherein said plunger head includes a lip portion which engages a pair of tongue members attached to an upper end of said pair of jaws, wherein when said plunger head is retracted by said lower hydraulic cylinder said lip portion engages said pair of tongue members thereby opening said jaws and releasing an engaged spike.

2. The spike removing system of claim 1, wherein said lifting means comprises an upper hydraulic cylinder having a first inner shaft, wherein said first inner shaft attaches said lower hydraulic cylinder opposite of said plunger head.

3. The spike removing system of claim 2, wherein said housing is elongated and lightweight.

4. A spike removing system comprising:

a housing having an upper end and a lower end, said lower end including an opening;

a lifting means secured within said housing;

an engaging means attached to said lifting means for engaging a deeply embedded spike;

wherein said engaging means comprises at least one pair of jaws having a corresponding lower end opposing one another, wherein said at least one pair of jaws are pivotally attached to a means for closing and opening said pair of jaws; and wherein said means for closing and opening said pair of jaws comprises:

a lower hydraulic cylinder having a second inner shaft, wherein said lower hydraulic cylinder is attached to said lifting means; and a plunger head attached to a distal end of said second inner shaft, wherein said plunger head projects between an upper portion of said pair of jaws for closing said pair of jaws; and wherein said plunger head includes a lip portion which engages a pair of tongue members attached to an upper end of said pair of jaws, wherein when said plunger head is retracted by said lower hydraulic cylinder said lip portion engages said pair of tongue members thereby opening said jaws and releasing an engaged spike.

* * * * *